US011077704B2

(12) United States Patent
Vuille et al.

(10) Patent No.: US 11,077,704 B2
(45) Date of Patent: Aug. 3, 2021

(54) METHOD OF FABRICATING AN EMBOSSED DECORATION PROVIDED WITH AN ATTACHMENT

(71) Applicant: The Swatch Group Research and Development Ltd, Marin (CH)

(72) Inventors: Pierry Vuille, Les Emibois (CH); Yves Winkler, Schmitten (CH)

(73) Assignee: The Swatch Group Research and Development Ltd, Marin (CH)

( * ) Notice: Subject to any disclaimer, the term of this patent is extended or adjusted under 35 U.S.C. 154(b) by 116 days.

(21) Appl. No.: 16/334,069

(22) PCT Filed: Sep. 22, 2017

(86) PCT No.: PCT/EP2017/074084
§ 371 (c)(1),
(2) Date: Mar. 18, 2019

(87) PCT Pub. No.: WO2018/069023
PCT Pub. Date: Apr. 19, 2018

(65) Prior Publication Data

US 2019/0210402 A1 Jul. 11, 2019

(30) Foreign Application Priority Data

Oct. 13, 2016 (EP) ..... 16193773

(51) Int. Cl.

| | |
|---|---|
| ***B44C 5/00*** | (2006.01) |
| ***G04D 3/00*** | (2006.01) |
| ***G04B 19/10*** | (2006.01) |
| ***G04B 19/04*** | (2006.01) |

(52) U.S. Cl.
CPC ..... *B44C 5/00* (2013.01); *G04B 19/042* (2013.01); *G04B 19/103* (2013.01); *G04D 3/0051* (2013.01)

(58) Field of Classification Search
CPC ..... B44C 5/00; G04D 3/0051; G04B 19/103; G04B 19/042
See application file for complete search history.

(56) References Cited

U.S. PATENT DOCUMENTS 3,410,699 A * 11/1968 Peters ..... A01J 19/00 426/104

FOREIGN PATENT DOCUMENTS

| | | |
|---|---|---|
| CH | 201862 | 12/1938 |
| CH | 260124 | 2/1949 |
| JP | 60-235086 A | 11/1985 |
| JP | 2006-29976 A | 2/2006 |

OTHER PUBLICATIONS

International Search Report dated Dec. 4, 2017 in PCT/EP2017/074084 filed Sep. 22, 2017.

* cited by examiner

*Primary Examiner* — Rick K Chang
(74) *Attorney, Agent, or Firm* — Oblon, McClelland, Maier & Neustadt, L.L.P.

(57) ABSTRACT

A method of fabricating a decoration provided with at least one attachment includes forming an envelope of material, the envelope including an external surface and an internal surface, and the external surface including a visible embossed part of the decoration, forming the at least one attachment, and fastening the at least one attachment directly and permanently against the internal surface of the envelope of the decoration.

13 Claims, 1 Drawing Sheet

METHOD OF FABRICATING AN EMBOSSED DECORATION PROVIDED WITH AN ATTACHMENT

FIELD OF THE INVENTION

The invention relates to an embossed decoration provided with an attachment enabling it to be fixed to a part.

BACKGROUND OF THE INVENTION

It is known to fabricate index times in the form of appliqués, that is to say solid parts that are machined and then attached to the dial for example by riveting the feet of each appliqué into the body of the dial.

The necessary individual fabrication of such appliqués is complicated in particular because of the difficulties of colouring and finishing the visible faces.

SUMMARY OF THE INVENTION

The aim of the present invention is to alleviate some or all of the disadvantages cited above by proposing a method of fabrication that can be automated, uses less material, makes possible a greater variety of materials whilst guaranteeing colours and a finish adapted to reduce the reject rate.

To this end, the invention relates to a method of fabricating a decoration provided with an attachment including the following steps:

a) forming an envelope of material the external surface of which forms the visible embossed part of the decoration;

b) mounting at least one attachment for fixing the decoration against the internal surface of the envelope.

It is therefore clear that the method allows the fabrication of an embossed decoration provided with at least one attachment the envelope of which forms a material "skin", that is to say a predetermined thickness of material, the rest of the volume being empty of said material, which enables very significant reduction of the cost of the material and the weight of the decoration.

It is therefore possible, for example, to fabricate an appliqué the visible embossed surface of which is based on a precious metal, such as gold, whilst limiting its intrinsic cost by using the material based on a precious metal only for the thickness of the envelope and not for the entirety of the decoration.

Moreover, in accordance with the invention the material used for said at least one attachment may advantageously be totally independent of the material used for the envelope. It is therefore possible, for example, to fabricate an attachment in a more usual metal such as brass or polymer material enabling varied shaping.

Finally, the method including fewer steps, it can be automated, that is to say that fabrication may be partly or totally carried out with the aid of automata in order to reduce the cost of the decorations.

According to other advantageous variants of the invention:

step a) includes phases a1): forming an imprint of said decoration in a substrate, then a2): covering said imprint with a layer of material and, where applicable, a3): removing the substrate in order to obtain a material envelope the external surface of which forms the visible embossed part of said decoration;

step a) includes phases a4): obtaining a sheet of material, then a5): deforming the sheet of material in such a manner as to form a material envelope and, where applicable, a6): removing said envelope from the rest of the sheet in order to obtain an envelope the external surface of which forms the visible embossed part of said decoration;

step a) includes phases a7): forming a mould for said decoration then a8): covering the mould with material in order to form a material envelope and, where applicable, a9): removing the mould in order to obtain an envelope the external surface of which forms the visible embossed part of said decoration;

step b) includes phases b1): forming said at least one attachment, then b2): fastening said at least one attachment against the internal surface of the envelope of the decoration formed in step a);

step b) includes a phase b3): filling the internal surface of the envelope of the decoration formed in step a) with a material to form said at least one attachment;

the material of the envelope includes a precious metal;

the decoration forms all or part of a bezel, a dial, an appliqué or a hand of a timepiece.

BRIEF DESCRIPTION OF THE DRAWINGS

Other particular features and advantages will emerge clearly from the following description thereof given by way of nonlimiting illustration with reference to the appended drawings, in which.

DETAILED DESCRIPTION OF PREFERRED EMBODIMENTS

The invention relates to a method of fabricating an embossed decoration provided with an attachment able, for example, to form all or part of a bezel, a dial, an appliqué or a hand of a timepiece. In fact, for reasons of aesthetics and durability, these decorations are generally produced from materials that are relatively insensitive to the oxidizing atmosphere of the air. It is relatively frequent in top of the range timepieces that the index hours, the dial or the hands are formed from precious metals, such as gold, which makes the casing of the timepieces very costly.

With the aim of making decorations more affordable even when based on precious metals, the present method includes a first step a) intended to form an envelope of material the external surface $S_E$ of which forms the visible embossed part of the decoration.

It is therefore clear that the decoration includes an embossed envelope that forms a "skin" of material, that is to say a predetermined thickness of material, the rest of the volume being empty of said material, which enables very significant reduction of the cost of the material and the mass of the decoration. It is therefore possible, for example, to fabricate an appliqué the visible embossed surface of which is based on a precious metal, such as gold, whilst limiting its intrinsic cost by using the material based on a precious metal only for the thickness of the envelope and not for the whole of the decoration.

Figure 1:
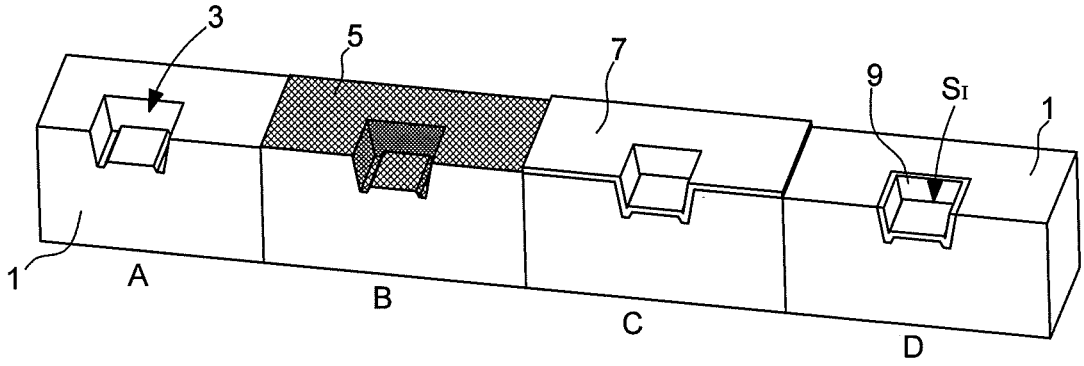
FIG. 1 is a representation of a step a) according to the invention.

In a first embodiment, the first step a) may include a first phase a1) intended to form an imprint 3 of said decoration in a substrate 1 as can be seen in FIG. 1A. The substrate 1 may be of various kinds such as for example based on silicon, ceramic or metal.

In the first embodiment, step a) continues with a second phase a2) intended to cover the imprint 3 with a layer 7 of material intended to form the envelope 9 of the future decoration. The layer 7 of material may, for example, be deposited by galvanic growth, by physical vapour phase deposition (PVD), by chemical vapour phase deposition (CVD), by atomic layer deposition (ALD) or by any other additive method.

As shown in FIGS. 1B and 1C, depending on the nature of the required envelope 9, that of the substrate 1 and the deposition method, the second phase a2) may include preparation of the substrate 1 and then, only afterwards, the deposition of the material 7 of the envelope 9.

As shown in FIG. 1B, the preparation of the substrate 1 is intended to enable adhesion of the material 7 to the substrate 1. Preparation may therefore consist in roughening at least a part of the outer surface of the substrate 1 and/or depositing a bonding layer onto at least one part of the upper surface of the substrate 1 and/or depositing a technical layer on at least one part of the upper surface of the substrate 1 to enable the deposition of the material 7 as shown in FIG. 1C.

Of course, depending on the deposition method, the layer 7 may be deposited on all or part of the upper surface of the substrate 1 and at least in such a manner as to cover without necessarily completely filling the imprint 3 of the future decoration 15.

In a nonlimiting manner, the example from FIGS. 1B to 1D proposes depositing an electrically conductive layer 5 onto all of the upper surface of the substrate 1 by physical vapour phase deposition, depositing the layer 7 by galvanic growth from the layer 5, that is to say over all the upper surface of the substrate 1, and then leaving the layer 7 only in the imprint 3 in order to form the envelope 9. This example enables production of a plurality of different or identical envelopes 9 on the same substrate 1, that is to say mass production of the envelopes 9.

Of course, as explained above, types of deposition other than galvanic growth may be used. Moreover, it is instead equally possible to deposit the layer 7 directly and only in each imprint 3, that is to say to go directly from FIG. 1A to FIG. 1D.

For example, it is therefore possible to use a sacrificial layer not covering the imprint 3 which, after depositing the layer 7, will be removed leaving only the layer 7 in the imprint 3. This technique is known as "lift-off". Another alternative technique may be to use a stencil mask on the trajectory of the material to be deposited, sometimes referred to as "stencil lithography".

In a second embodiment, step a) includes a first phase a4) intended to provide a sheet of the material intended to form the envelope 9 of the decoration 15. The step could then continue with the second phase a5) intended to deform the sheet of material in such a manner as to form said material envelope. In a similar manner to the first embodiment, a plurality of different or identical envelopes 9 could be produced on the same sheet of material, i.e. the envelopes 9 could be mass produced. The film could equally and advantageously be used as a support.

For example, a sheet of amorphous metal alloy based on precious metals, such as based on palladium or platinum, may be employed. In fact, an amorphous metal alloy of this kind is easy to deform when it is heated between its glass transition temperature and its crystallization temperature. Moreover, it advantageously has a very high elastic limit enabling it to be particularly indicated for an application to a casing part.

Accordingly, in the case of an amorphous metal alloy, the second phase a5) could, for example, be conducted by stamping or by blow moulding.

Finally, in a third embodiment, the step a) includes a first phase a7) intended to form a mould for said decoration, for example using photolithography in order to form a plurality of levels of photosensitive resin structured according to the pattern of the future decoration. This third embodiment could be a positive alternative to the first embodiment, that is to say instead or creating an imprint 3 destructively, it is formed in an additive manner, for example by photolithography.

In the third embodiment, the step a) includes a second phase a8) intended to cover the material mould in order to form directly or indirectly the material envelope 9. In fact, depending on the shape of the decoration 15, either the mould is covered with the layer 7 of similar material to the first embodiment or the mould is filled to form a massive blank that is thereafter hollowed out to obtain the envelope 9 indirectly.

Regardless of the embodiment of the first step a), the method enables provision of an external surface $S_E$ of the envelope 9 that will have a colour and a finish that will depend on the method of deposition, the material deposited and the roughness of the substrate 1, the sheet or the mould, in a highly reproducible manner.

Regardless of the embodiment of the first step a), the method continues with the second step b) intended to mount at least one attachment 13 adapted for fixing the decoration 15 against the internal surface $S_I$ of the envelope 9.

According to the invention, the material used for said at least one attachment 13 may be totally independent of the material used for the envelope 9. It is therefore possible, for example, to fabricate an attachment 13 in a more usual metal such as brass or in polymer material enabling varied shaping without modifying either the colour or the finish of the external surface $S_E$ of the envelope 9.

Figure 2:
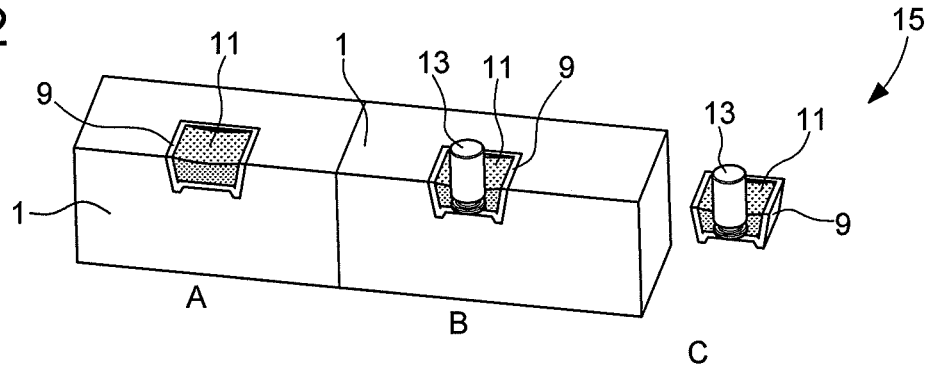
FIG. 2 is a representation of a step b) according to the invention.

In a first embodiment, the step b) includes a first phase b1) intended to form said at least one attachment 13 and then a second phase b2) intended to fasten said at least one attachment against the internal surface $S_I$ of the envelope 9 formed during the step a) as shown in FIG. 2B.

Phase b1) in accordance with the invention may advantageously be carried out by any preferred type of method. Indeed, because the attachment (or the attachments) provided is (or are) not dependent on the material chosen for the envelope 9, no restriction is to be endured as to the material of said at least one attachment 13 or as to the method of fabricating said at least one attachment 13.

For example, FIG. 2B shows an attachment in the form of a prismatic volume of circular section. Of course, a plurality of attachments 13 could instead be formed during phase b1) in a one-piece or other manner. Indeed, it may be imagined that two attachments 13 are joined by means of a base, like a staple, to form a one-piece element or that a plurality of independent attachments 13 are formed.

Phase b2) according to the invention may advantageously be carried out using a plurality of types of preferred method. Indeed, according to the attachment (or the attachments) provided and the envelope 9 provided, a plurality of types of fastening may be envisaged. In a nonlimiting manner there may be envisaged gluing, welding or brazing each attachment 13 against the internal surface $S_I$ of the envelope 9.

The nonlimiting example of FIGS. 2B to 2D proposes depositing a fastening material 11, such as glue, against the internal surface $S_I$ of the envelope 9 and then fitting said at least one attachment 13 against the internal surface $S_I$ of the envelope 9 via the layer 11 of fastening material. This example enables production of a plurality of different or identical decorations 15 on the same substrate 1, that is to say, once freed from the substrate 1, mass production of the decorations 15.

Note that this advantage is preserved even for the other two embodiments of step a), that is to say respectively using the same sheet or the same mould.

In a second embodiment, step b) may instead include a phase b3) intended to fill the internal surface $S_I$ of the envelope 9 with a material forming said at least one attachment 13. Indeed, there may be imagined, for example, the injection of an adherent polymer material against the internal surface $S_I$ of the envelope 9 the injection stalk or stalks of which enable formation of said at least one attachment 13. Of course, said at least one attachment 13 may be obtained by using a matrix over the envelope 9 enabling a predetermined shape to be imparted to the injection.

Note therefore that the method includes fewer steps than the fabrication of a traditional appliqué. It is also immediately obvious that the use of the substrate 1, the sheet or the mould, respectively, renders the method automatable, that is to say that fabrication may be partially or totally carried out using automata in order to reduce the cost of the decorations 15.

Figure 3:
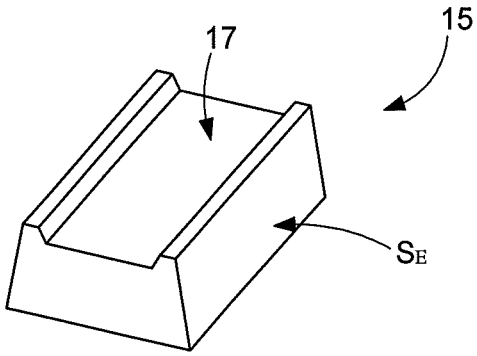
FIGS. 3 and 4 are representations of a decoration according to the invention.
Figure 4:
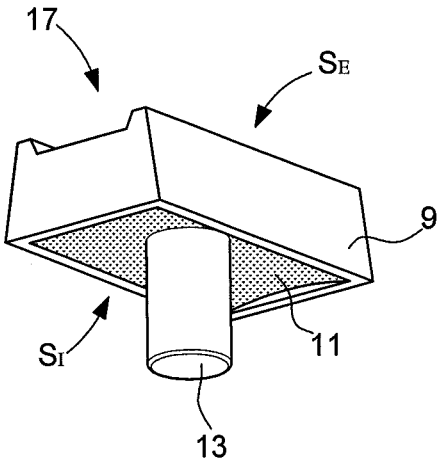

In the nonlimiting example from FIGS. 2C, 3 and 4, a decoration 15 is obtained formed by an embossed envelope 9 formed that is based for example on gold and the external surface $S_E$ of which determines the visible part of the decoration 15. It is apparent that a recess 17 may be provide in order to receive for example a luminescent substance such as Super-Luminova® paint or to create a particular aesthetic form.

The decoration 15 further includes an attachment 13 fastened against the internal surface $S_I$ of the envelope 9 by means of a glue 11. Once fixed, for example by riveting it in the hole in a dial, the attachment 13 will be totally masked and only the external surface $S_E$ will remain visible without it being possible to distinguish the decor 15 from a traditional appliqué in terms of its colour and its finish.

Of course, the present invention is not limited to the example shown but lends itself to various modifications and variants that will be apparent to the person skilled in the art. In particular, at the end of step a), the envelope 9 could be removed from the substrate 1, the sheet or the mould before carrying out step b).

Moreover, the internal surface $S_I$ of the envelope 9 could equally include a shape, such as a groove or a rib, intended to improve the adhesion and/or the positioning of said at least one attachment.

Finally, in the case of a coating, as shown in FIG. 1C, removing the surplus material 7 not during step a) but at the end of step b) may equally be envisaged without losing the advantages of the invention.

The invention claimed is:

1. A method of fabricating a decoration provided with at least one attachment, comprising:

a) forming an envelope of material, the envelope including an external surface and an internal surface, and the external surface including a visible embossed part of the decoration;

b) forming the at least one attachment; and c) fastening the at least one attachment directly and permanently against the internal surface of the envelope of the decoration.

2. The method according to claim 1, wherein the step a) comprises:

a1) forming an imprint of the decoration in a substrate; and a2) covering the imprint with a layer of the material.

3. The method according to claim 2, wherein the step a) further comprises after a1) and a2):

a3) removing the substrate in order to obtain the envelope of the material, the external surface including the visible embossed part of the decoration.

4. The method according to claim 1, wherein the step a) comprises:

a1) obtaining a sheet of the material; and a2) deforming the sheet of the material in order to form the envelope of the material.

5. The method according to claim 4, wherein the step a) further comprises after a1) and a2):

a3) removing the envelope from the rest of the sheet in order to obtain the envelope, the external surface including the visible embossed part of the decoration.

6. The method according to claim 1, wherein the step a) comprises:

a1) forming a mould for the decoration; and a2) covering the mould with the material in order to form the envelope of the material.

7. The method according to claim 6, wherein the step a) further comprises after a1) and a2):

3) removing the mould in order to obtain the envelope, the external surface including the visible embossed part of the decoration.

8. The method according to claim 1, wherein the material of the envelope includes a precious metal.

9. The method according to claim 1, wherein the decoration forms all or part of a bezel, a dial, an appliqué a hand of a timepiece.

10. The method according to claim 1, wherein fastening the at least one attachment directly and permanently includes gluing the at least one attachment to the internal surface of the envelope.

11. The method according to claim 1, wherein fastening the at least one attachment directly and permanently includes welding the at least one attachment to the internal surface of the envelope.

12. The method according to claim 1, wherein fastening the at least one attachment directly and permanently includes brazing the at least one attachment to the internal surface of the envelope.

13. The method according to claim 1, wherein the steps b) and c) include filling a volume of a cavity defined by the internal surface of the envelope with a material that forms the at least one attachment.

* * * * *